United States Patent [19]

Kubota et al.

[11] Patent Number: 4,643,965

[45] Date of Patent: Feb. 17, 1987

[54] DIRECT POSITIVE PHOTOGRAPHIC LIGHT-SENSITIVE MATERIALS

[75] Inventors: Satosi Kubota; Tetsuo Yoshida; Hideki Ohmatsu, all of Kanagawa, Japan

[73] Assignee: Fuji Photo Film Co., Ltd., Kanagawa, Japan

[21] Appl. No.: 613,702

[22] Filed: May 24, 1984

[30] Foreign Application Priority Data

May 24, 1983 [JP] Japan ..... 58-91040

[51] Int. Cl.[4] ..... G03C 1/28

[52] U.S. Cl. ..... 430/567; 430/604; 430/605; 430/598; 430/940; 430/409; 430/608

[58] Field of Search ..... 430/604, 409, 608, 564, 430/567, 605, 598, 940

[56] References Cited

U.S. PATENT DOCUMENTS 3,317,322 5/1967 Porter et al. ..... 430/567
3,761,276 9/1973 Evans ..... 430/567
4,035,185 7/1977 Evans et al. ..... 430/567
4,395,478 7/1983 Hoyen ..... 430/217
4,444,865 4/1984 Silverman et al. ..... 430/598

*Primary Examiner*—Won H. Louie
*Attorney, Agent, or Firm*—Sughrue, Mion, Zinn, Macpeak, and Seas

[57] ABSTRACT

A direct positive photographic light-sensitive material is described, comprising a support and at least one internal latent image type silver halide emulsion layer containing core/shell type silver halide grains which are composed of a silver halide core subjected to at least one of doping with metal ions and chemical sensitization, and a silver halide shell covering at least sensitivity sites of said core, and a binder, wherein said core/shell type silver halide grains consist of two or more kinds of grains each having a different average grain size, and the core of the core/shell type silver halide grains having a larger average grain size is doped with a larger amount of lead ions, cadmium ions, or Group VIII metal ions.

11 Claims, No Drawings

DIRECT POSITIVE PHOTOGRAPHIC LIGHT-SENSITIVE MATERIALS

FIELD OF THE INVENTION

The present invention relates to direct positive photographic light-sensitive materials and particularly to direct positive photographic light-sensitive materials having internal latent image type silver halide emulsions having good reversal photographic characteristics, which are very stable in the photographic properties even if stored prior to use under severe conditions, such as high temperature and high humidity, or high temperature and low humidity.

BACKGROUND OF THE INVENTION

Hitherto, it has been known that reversal images are obtained by developing internal latent image type silver halide grains, which are composed of a core of silver halide doped with metal ions, chemically sensitized, or subjected to both treatment and a shell of the silver halide covering at least sensitivity sites of the core (hereinafter referred to as core/shell type grains), in which the surface of the shell is, if desired, chemically sensitized, in the presence of a fogging agent, or by a direct reversal process that an overall light-exposure is applied at the time of development. Such are described, for example, in U.S. Pat. Nos. 3,317,322 and 3,761,276, etc.

If such core/shell type silver halide grains are used, good reversal photographic characteristics can be obtained. However, such core/shell type silver halide emulsions have had a problem in that stability with the passage of time is unsatisfactory. Particularly, if subjected to severe conditions such as high temperature and high humidity, the reversal photographic characteristics easily deteriorate.

Further, if two or more kinds of core/shell type silver halide grains each having a different average grain size, are used for direct positive photographic light-sensitive materials in order to expand exposure latitude, the direct positive photographic light-sensitive materials exhibit a problem in that stability with the passage of time deteriorates even more rapidly. Moreover, if direct positive photographic light-sensitive materials are exposed to an atmosphere containing oxygen and moisture as a normal state during storage prior to use, this tendency is even more pronounced.

SUMMARY OF THE INVENTION

An object of the present invention is to provide direct positive photographic light-sensitive materials having good reversal photographic characteristics, good stability with the passage of time and wide exposure latitude, which do not exhibit the above described problems.

Another object of the present invention is to provide direct positive photographic light-sensitive materials which have good stability with the passage of time even if exposed to an atmosphere containing oxygen and moisture as a normal state.

The above objects of the present invention have been attained by providing direct positive photographic light-sensitive materials comprising a support and at least one internal latent image type silver halide emulsion layer containing core/shell type silver halide grains which are composed of a silver halide core subjected to at least one of doping with metal ions and chemical sensitization, and a silver halide shell which covers at least sensitivity sites of the core, and a binder, wherein the core/shell type silver halide grains consist of two or more kinds of grains, each having a different average grain size, and the core of the core/shell type silver halide grains having a larger average grain size is doped with a larger amount of lead ions, cadmium ions, or Group VIII metal ions.

DETAILED DESCRIPTION OF THE INVENTION

Each core/shell type silver halide grain used in the present invention is preferably a monodispersed grain, core/shell type silver halide grains having an average grain size of from about 0.1 to 4 microns and, more preferably, from about 0.2 to 2 microns, to produce good results.

The term "average grains size" as used herein means the average of the grain diameters when silver halide grains are spherical or nearly spherical, or the edge lengths when they are cubic, calculated based on projected areas.

The term "monodispersed emulsion" as used herein means an emulsion composed of silver halide grains each having a substantially uniform diameter.

Silver halide grains preferably used in the present invention are those wherein up to 95% of grains are within 40%, preferably within 30% of the average grain size.

Further, the term "different average grain size" as used herein means that the difference in the average grain size between the larger grains and the smaller grains is at least 0.1$\mu$ or is 20% or more in terms of the ratio thereof.

In the present invention, lead ions, cadmium ions, rhodium ions, iridium ions, osmium ions, platinum ions, palladium ions and ruthenium ions, etc., are used as metal ions for doping, and are used in a larger amount in core/shell type silver halide grains having a larger average grain size.

In order to dope cores with these metal ions, it is possible to use a process which comprises carrying out formation of silver halide grains as cores or physical ripening of cores in the presence of metal ion sources such as salts or complex salts of the desired metals.

The amount of metal ions doped is generally in a range of from $10^{-8}$ to $10^{-4}$ mols per mol of silver halide. In the case of lead ions and cadmium ions, they are preferably used in a range of from $10^{-8}$ to $10^{-4}$ mols, and in the case of Group VIII metals, they are preferably used in a range of from $10^{-8}$ to $10^{-5}$ mols, per mol of silver halide. Furthermore, grains having a larger average grain size are doped with metal ions in an excess amount of more than 10%, preferably more than 50%, and more preferably more than 100%, larger as compared with the amount in the grains having a smaller average grain size. In this case, similar good effects are shown, even if grains having a smaller average grain size are not at all doped with the above described metal ions.

In the present invention, the ratio of the core/shell type silver halide grains having a larger average grain size used is not restricted, but it is preferred that they are used in an amount of from 0.1 to 10 times, and more preferably $\frac{1}{3}$ to 3 times, by weight, the weight of the grains having a smaller average grain size.

The core/shell type silver halide grains composing emulsions for direct positive photographic light-sensitive materials of the present invention are obtained by first preparing cores subjected to at least one of doping with metal ions and chemical sensitization, then covering the surface of the cores with a silver halide shell, and, if desired, chemically sensitizing the shell. The whole surface of the cores need not necessarily be covered by the shell, and it is sufficient if at least sensitivity sites (which form photolysis silver upon exposure to light) of the cores are covered with the shell. For this doping of the core with metal ions, a method in which a metal ion source, such as cadmium salts, zinc salts, lead salts, thallium salts, iridium salts or its complex salts, rhodium salts or its complex salts, and iron salts or its complex salts, is present during the formation of silver halide grains constituting the core or physical ripening can be used.

Metal ions are usually used in a proportion of at least $10^{-8}$ mol per mol of silver halide. Silver halide of cores may be subjected to chemical sensitization with one or more kinds of noble metal sensitizers, sulfur sensitizers and reduction sensitizers instead of or together with doping with metal ions. Sensitivity particularly increases if gold sensitization and sulfur sensitization are jointly carried out. The above-described treatment of the silver halide of the core and a technique to cover the surface of silver halide grains constituting the core with silver halide constituting the shell are known. For example, the methods described in U.S. Pat. Nos. 3,206,316, 3,317,322, 3,367,778 (excluding a step of fogging the surface of grains), and 3,761,276 can be employed advantageously.

The ratio of the amount of silver halide used in the core to the amount of silver halide used in the shell is not critical and can be determined appropriately. Usually, the amount in the shell is employed in a proportion of from 2 to 8 mols per mol of the amount in the core.

The silver halide of the core and that of the shell preferably have the same composition, but they may have different compositions. Suitable silver halides which can be used herein include silver bromide, silver iodide, silver chloride, silver chlorobromide, silver bromoiodide, silver chlorobromoiodide, etc. The silver halide emulsion of the present invention is preferably composed of at least 50 mol% of silver bromide. Most preferred is a silver bromoiodide emulsion, especially containing about 10 mol% or less of silver iodide.

These core/shell type silver halide grains may have a regular crystal form such as a cubic or octahedral form, or may have an irregular crystal form such as a spherical form and a tabular form or a composite form thereof. Furthermore, a mixture of grains having different crystal forms may be used.

The surface of grains of core/shell type silver halide prepared as described above may be then chemically sensitized if desired.

The chemical sensitization of the core of the core/shell type silver halide grains can be performed using known techniques such as the methods described in Grafkides, *Chimie et Physique Photographique,* Paul Montel Co. (1967), V. L. Zelikman et al., *Making and Coating Photographic Emulsions,* The Focal Press Co. (1964), and H. Frieser ed., *Die Grundlagen der Photographischen Prozesse mit Silberhalogeniden,* Akadmische Verlagsgesellschaft (1968).

That is, a sulfur sensitization method using compounds containing sulfur capable of reacting with silver ion, or using active gelatin, a reduction sensitization method using reducing substances, a noble metal sensitization method using noble metal (e.g., gold) compounds, and so forth can be used alone or in combination with each other. Of these methods, a combination of the gold sensitization method and the sulfur sensitization method provides the best results. In some cases, the reduction sensitization method may be used in combination with the gold sensitization method and the sulfur sensitization method.

Sulfur sensitizers which can be used include thiosulfates, thioureas, thiazoles, and rhodanines. Representative examples are described in U.S. Pat. Nos. 1,574,944, 2,410,689, 2,278,947, 2,728,688 and 3,656,955. Reduction sensitizers which can be used include stannous salts, amines, hydrazine compounds, formamidinesulfinic acid, and silane compounds. Representative examples are described in U.S. Pat. Nos. 2,487,850, 2,419,974, 2,518,698, 2,983,609, 2,983,610 and 2,694,637. For noble metal sensitization, gold complex salts and complex salts of metals belonging to Group VIII of the Periodic Table such as platinum, iridium and palladium can be used. Representative examples are described in U.S. Pat. Nos. 2,399,083, 2,448,060 and British Pat. No. 618,061.

Conditions under which the chemical sensitization is performed can be determined appropriately. In general, preferred results are obtained when the chemical sensitization is conducted under conditions so that the pH is 9 or less, the pAg is 10 or less, and the temperature is 40° C. or higher. In some cases, however, conditions not falling within the above-defined ranges may be employed. The chemical sensitization of the core/shell type silver halide grain surface is performed to such an extent that the characteristics as an internal latent image type emulsion are not degraded. The term "characteristics as an internal latent image type emulsion" is used herein to mean that the maximum density of a light-sensitive material, the material comprising a transparent support and a given emulsion coated thereon, when exposed to light for a predetermined time of from 0.01 to 10 seconds and developed with Developer A (an internal type developer) as described below at 20° C. for 3 minutes (the density is determined by the usual photographic density measuring method) is at least 5 times greater than that of the same material as described above when exposed to light in the same manner as above and developed with Developer B (a surface type developer) also as described below at 20°0 C. for 4 minutes.

| | |
|---|---|
| Developer A | |
| Hydroquinone | 15 g |
| Monomethyl-p-aminophenol Sesquisulfate | 15 g |
| Sodium Sulfite | 50 g |
| Potassium Bromide | 10 g |
| Sodium Hydroxide | 25 g |
| Sodium Thiosulfate | 20 g |
| Water to make | 1000 ml |
| Developer B | |
| p-Oxyphenolglycine | 10 g |
| Sodium Carbonate | 100 g |
| Water to make | 1000 ml |

The core/shell type silver halide grains are dispersed in a binder.

Gelatin can be used advantageously as a binder. Other hydrophilic colloids can also be used. Examples of suitable hydrophilic colloids are proteins such as gelatin derivatives, graft polymers of gelatin and other polymers, albumin and casein, cellulose derivatives such as hydroxyethyl cellulose, carboxymethyl cellulose and cellulose sulfuric acid esters, and sugar derivatives such as sodium alginate and starch derivatives.

Lime-processed gelatin, acid-processed gelatin and enzyme-processed gelatin as described in *Bull. Soc. Sci. Photo.*, Japan, No. 16, page 30 (1966) can be used as the gelatin. In addition, hydrolyzates and enzyme decomposition products of gelatin can be used. As gelatin derivatives, it is possible to use those obtained by reacting gelatin with various compounds, for example, acid halides, isocyanates, bromoacetic acid, alkanesultones, vinylsulfonamides, maleimide compounds, polyalkylene oxides and epoxy compounds, etc. Examples thereof have been described in U.S. Pats. Nos. 2,614,928, 3,132,945, 3,186,846 and 3,312,533; British Pat. Nos. 861,414, 1,033,189 and 1,005,784; and Japanese Patent Publication No. 26845/67, etc.

As the above described graft polymers of gelatin, it is possible to use those prepared by grafting homo- or co-polymers of vinyl monomers such as acrylic acid, methacrylic acid or derivatives thereof such as esters or amide, etc., acrylonitrile or styrene, etc., on gelatin. Particularly, it is preferred to use graft polymers prepared by grafting polymers having a certain degree of compatibility with gelatin, such as polymers of acrylic acid, methacrylic acid, acrylamide, methacrylamide or hydroxyalkyl methacrylate, etc. on gelatin. Examples thereof have been described in U.S. Pats. Nos. 2,763,625, 2,831,767, 2,956,884, etc.

The internal latent image type silver halide emulsion of the present invention may be spectrally sensitized with methine dyes and so forth. Dyes which can be used include cyanine dyes, merocyanine dyes, complex cyanine dyes, complex merocyanine dyes, holopolar cyanine dyes, hemicyanine dyes, styryl dyes, and hemioxonol dyes. Particularly useful dyes are cyanine, merocyanine and complex merocyanine dyes. In these dyes, any of the nuclei commonly used as heterocyclic nuclei in cyanine dyes can be employed. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, and a pyridine nucleus; nuclei resulting from the fusion of alicyclic hydrocarbon rings to the foregoing nuclei; and nuclei resulting from the fusion of aromatic hydrocarbon rings to the foregoing nuclei, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be employed. These nuclei may contain substituents on the carbon atom thereof.

The merocyanine or complex merocyanine dyes may contain nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, and a thiobarbituric acid nucleus.

Useful sensitizing dyes are described in, for example, West German Pat. No. 929,080, U.S. Pat. Nos. 2,231,658, 2,493,748, 2,503,776, 2,519,001, 2,912,329, 3,655,394, 3,656,959, 3,672,897, 3,694,217, British Pat. No. 1,242,588 and Japanese Patent Publication No. 14030/69.

These sensitizing dyes can be used alone or as a combination with each other. Combinations of sensitizing dyes are often used for the purpose of supersensitization. Typical examples of such combinations are described in, for example, U.S. Pat. Nos. 2,688,545, 2,977,229, 3,397,060, 3,522,052, 3,527,641, 3,617,293, 3,628,964, 3,666,480, 3,679,428, 3,703,377, 3,769,301, 3,814,609, 3,837,862, British Pat. No. 1,344,281, and Japanese Patent Publication No. 4936/68.

The emulsions may contain dyes which do not have a spectral sensitization function themselves, or may contain substances which do not substantially absorb visible light but show supersensitization function, together with the sensitizing dyes. For example, they may contain aminostilbene compounds substituted with nitrogen-containing heterocyclic groups (for example, those described in U.S. Pats. Nos. 2,933,390 and 3,635,721), aromatic acid-formaldehyde condensates (for example, those described in U.S. Patents 3,743,510), cadmium salts and azaindene compounds, etc. Combinations described in U.S. Pats. Nos. 3,615,613, 3,615,641, 3,617,295 and 3,635,721 are particularly useful.

In order to produce direct positive photographic light-sensitive materials using the internal latent image type silver halide photographic emulsions, the photographic emulsions are applied to supports together with, if desired, other photographic layers. In this case, two or more kinds of internal latent image type silver halide grains each having a different grain size may be mixed and applied to the same layer, or they may be applied, respectively, so as to form two or more different layers.

The amount of the emulsion coated is not critical in the present invention. Usually, when the emulsion is coated in an amount such that the amount of silver is from about 40 to about 800 mg per square feet of the support, a desirable reversal image can be obtained.

Suitable supports are those as described in *Research Disclosure,* Vol. 176, RD-17643, clause XVII (1978).

The internal latent image type silver halide photographic emulsion of the present invention may contain compounds such as polyalkylene oxides or the ether, ester, amine or like derivatives thereof, thioether compounds, thiomorpholines, quaternary ammonium salts, urethane derivatives, urea derivatives, imidazole derivatives and 3-pyrazolidones for the purpose of increase in sensitivity and in contrast or of acceleration in development. For example, the compounds described in U.S. Pat. Nos. 2,400,532, 2,423, 549, 2,716,062, 3,617,280, 3,772,021 and 3,808,003 can be used.

The internal latent image type silver halide photographic emulsion of the present invention may contain antifoggants and stabilizers. For example, the compounds as described in *Research Disclosure,* Vol. 176, RD-17643 (1978), clause VI can be used.

The internal latent image type silver halide photograhic emulsion of the present invention may contain developing agents. For example, the developing agents as described in *Research Disclosure,* Vol. 176, RD-17643 (1978), clause XX can be used.

The internal latent image type silver halide photographic emulsion of the present invention can be dispersed in colloids hardenable with various organic or inorganic hardeners. For example, the hardeners as described in *Research Disclosure,* Vol. 176, RD-17643 (1978), Section X can be used.

The internal latent image type silver halide photographic emulsion of the present invention may contain coating aids. Those compounds as described in *Research*

*Disclosure,* Vol. 176, RD-17643 (1978), clause XI can be used as these coating aids.

The internal latent image type silver halide photographic emulsion of the present invention may contain the so-called color couplers. Those compounds as described in *Research Disclosure,* Vol. 176, RD-17643 (1978), clause VII can be used as these color couplers.

The internal latent image type silver halide photographic emulsion of the present invention may further contain additives such as antistatic agents, plasticizers, matting agents, lubricants, ultraviolet absorbers, brightening agents, and anti-air oxidants.

Dyes may be incorporated into the photographic emulsion layers and other hydrophilic colloid layers of the light-sensitive materials prepared using the internal latent image type silver halide photographic emulsion of the present invention as filter dyes or for various purposes such as prevention of irradiation. For example, the dyes are described in *Research Disclosure,* Vol. 176, RD-17643 (1978), clause VIII can be used.

The internal latent image type silver halide photographic emulsion of the present invention is developed in the presence of fogging agents (nucleating agents) or with an overall exposure to light. Typical examples of fogging agents which can be used include hydrazines as described in U.S. Pat. Nos. 2,588,982 and 2,563,785; hydrazines and hydrazones as described in U.S. Pat. No. 3,277,552; quaternary salt compounds as described in U.S. Pat. No. 1,283,835, Japanese Patent Publication No. 38164/74, U.S. Pat. Nos. 3,615,615, 3,719,494, 3,734,738, 4,094,683 and 4,115,122; sensitizing dyes containing a nucleating substituent as described in U.S. Pat. No. 3,718,470; acylhydrazinophenylthiourea compounds as described in U.S. Pat. Nos. 4,030,925 and 4,013,127; and acylhydrazinophenylurea compounds as described in Japanese Patent application (OPI) No. 86829/82 (the term "OPI" as used herein refers to a "published unexamined Japanese patent application"). In addition, the compounds as described in U.S. Pat. No. 4,139,387 and Japanese Patent Application (OPI) Nos. 133126/79 and 74729/79 can be used.

It is desirable for the fogging agent to be employed in an amount such that the resulting internal latent image type silver halide emulsion, when developed with a surface developer, provides a maximum density which is sufficiently satisfactory. Preferably the fogging agent is incorporated into the photographic emulsion layers or their adjacent layers.

The internal latent image type silver halide photographic emulsion of the present invention can be used in various applications. In particular, it is useful as an emulsion for direct positive photographic light-sensitive materials, as an emulsion for multilayer reversal color light-sensitive materials, and as an emulsion for use in the color diffusion transfer process of multilayer light-sensitive materials.

The internal latent image type silver halide photographic emulsion of the present invention can be used in combination with diffusion transfer color image-providing substances releasing a diffusible dye as development progresses, so that after a suitable developing treatment the desired transferred image can be obtained in an image-receiving layer. A number of diffusion transfer dye image-providing substances are known. For example, the compounds as described in U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, 3,928,312, 4,013,633, 3,932,380, 3,954,476, 3,942,987, 4,013,635, U.S. Patent Publication (USB) No. 351,673, British Pat. Nos. 840,731, 904,364, 1,038,331, West German Patent Application (OLS) Nos. 1,930,215, 2,214,381, 2,228,361, 2,317,134, 2,402,900, French Pat. No. 2,284,140, Japanese Patent Application (OPI) Nos. 113624/76 (corresponding to U.S. Pat. No. 4,055,428), 104343/76, 149328/78 and 143323/78 can be used. It is preferred to use dye image-providing substances of the type that is originally non-diffusible but undergoes cleavage after a redox reaction with the oxidized product of a developing agent, releasing a diffusible dye. These compounds are hereinafter referred to as "DRR compounds".

Particularly preferred compounds used together with the photographic emulsions of the present invention are DRR compounds having an o-hydroxyarylsulfamoyl group, as described in Japanese Patent Application (OPI) No. 113624/76, and DRR compounds having a redox nucleus described in Japanese Patent Application (OPI) No. 149328/78. If such DRR compounds are used together, temperature dependence during processing becomes very small.

Examples of the DRR compounds include the following compounds in addition to those described in the above described patents. As a magenta dye image forming substance, there is 1-hydroxy-2-tetramethylenesulfamoyl-4-[3'-methyl-4'-(2''-hydroxy-4''-methyl-5''-hexadecyloxyphenylsulfamoyl)phenylazo]naphthalene. As a yellow dye image forming substance, there is 1-phenyl-3-cyano-4-{3'-[2''-hydroxy-4''-methyl-5''-(2''',4'''-di-t-pentylphenoxyacetamino)phenylsulfamoyl]-phenylazo}-5-pyrazolone, etc.

The processing in the present invention can be carried out by any known process. More specifically, the process may comprise only a development step and a fixing step, and, if desired, a stopping step and water wash steps can be provided. The processing temperature is generally selected from a range of 18° C. to 50° C., but a temperature lower than 18° C. or a temperature higher than 50° C. may also be used.

Various known developing agents can be used for developing light-sensitive materials prepared using the emulsion of the present invention. For example, polyhydroxybenzenes such as hydroquinone, 2-chlorohydroquinone, 2-methylhydroquinone, catechol, and pyrogallol; aminophenols such as p-aminophenol, N-methyl-p-aminophenol, and 2,4-diaminophenol; 3-pyrazolidones such as 1-phenyl-3-pyrazolidones, 1-phenyl-4,4-dimethyl-3-pyrazolidone, 1-phenyl-4-methyl-4-hydroxymethyl-3-pyrazolidone, and 5,5-dimethyl-1-phenyl-3-pyrazolidone; and ascorbic acids can be used alone or in combination with each other. More specifically, for example, the developers described in Japanese Patent Application (OPI) No. 55928/83 can be used.

In forming dye images in the presence of dye-forming couplers, aromatic primary amine developing agent, preferably p-phenylenediamine-based developing agents, can be used. Typical examples are 4-amino-3-methyl-N,N-diethylaniline hydrochloride, N,N-diethyl-p-phenylenediamine, 3-methyl-4-amino-N-ethyl-N-β-(methanesulfonamido)ethylaniline, 3-methyl-4-amino-N-ethyl-N-(β-sulfoethyl)aniline, 3-ethoxy-4-amino-N-ethyl-N-(β-sulfoethyl)aniline, and 4-amino-N-ethyl-N-(β-hydroxyethyl)aniline. These developing agents may be incorporated into an alkaline processing composition (processing element) or into a suitable layer of the light-sensitive element.

Where DRR compounds are used, if they are cross-oxidizable, any silver halide developers can be used.

The developer may contain compounds such as sodium sulfite, potassium sulfite, ascorbic acid and reductones (e.g., piperidinohexose reductone) as preservatives.

A direct positive image can be obtained by developing the light-sensitive material of the present invention with surface developers. These surface developers are such that the process of development is induced substantially by latent images or fog nuclei present on the surface of the silver halide grains. Although it is preferred for the developer not to contain silver halide solvents, it may contain silver halide solvents (e.g., sulfites) as long as the internal latent image does not substantially contribute until the development with the surface development centers of silver halide grains is complete.

The developer may contain compounds such as sodium hydroxide, potassium hydroxide, sodium carbonate, potassium carbonate, trisodium phosphate, and sodium metaborate as alkalis or buffers. These agents are employed in an amount so as to control the pH of the developer within the range of from 10 to 13 and preferably from 11 to 12.5.

The developer may contain color development accelerators such as benzyl alcohol. In order to further lower the minimum density of the direct positive image, it is advantageous for the developer to contain compounds commonly used as antifoggants, such as benzimidazoles (e.g., 5-nitrobenzimidazole), and benzotriazoles (e.g., benzotriazole and 5-methylbenzotriazole).

The developing solution may also contain, if desired, dissolution aids, toning agents, development accelerators, defoaming agents, surface active agents, water softeners, hardeners, viscosity increasing agents, etc.

As a fixing solution, it is possible to use conventionally used compositions.

As a fixing agent, it is possible to use thiosulfates, thiocyanates and organic sulfur compounds which are known to have an effect as a fixing agent.

The fixing solution may contain water-soluble alminium salts as hardeners.

As a stop solution, an aqueous solution having a low pH is generally used. More specifically, a solution of acetic acid or sulfuric acid having a pH of 3.5 or less is used, which is preferred to contain buffers.

The light-sensitive material of the present invention can be processed with viscous developers. A viscous developer is a liquid composition containing the components necessary for developing the silver halide emulsion and for forming the diffusion transfer dye image. The solvent is composed mainly of water and sometimes contains hydrophilic solvents such as methanol and methyl Cellosolve. The processing composition contains a sufficient amount of alkali to maintain the pH necessary for causing development of the emulsion layer and further to neutralize acids (e.g., hydrohalic acids such as hydrobromic acid, and carboxylic acids such as acetic acid) formed during the steps of development and color image formation. Alkalis which can be used include alkali metal or alkaline earth metal salts, such as lithium hydroxide, sodium hydroxide, potassium hydroxide, a calcium hydroxide dispersion, tetramethyl ammonium hydroxide, sodium carbonate, trisodium phosphate, and the like, and amines such as diethylamine. Preferably sodium hydroxide is employed in a concentration such that the pH at room temperature is at least about 12 and particularly 14 or more. More preferably, the processing composition may contain hydrophilic polymers such as polyvinyl alcohols having a high molecular weight, hydroxyethyl cellulose, sodium carboxymethyl cellulose, etc. These polymers are preferably used in such an amount that the processing composition has a viscosity of 1 poise or more, and preferably at a viscosity of several hundred (500 to 600) to 1000 poises, at room temperature. Further, development inhibitors such as benzotriazole can be added to the processing composition.

When the light-sensitive material of the present invention is used in the diffusion transfer photographic process, it is preferably in the form of a film unit. This film unit, which is designed so that a light-sensitive element is processed by passing through a pair of pressure applying members arranged in a parallel relationship, is basically composed of the following three elements:

(1) A light-sensitive element containing an antifoggant;

(2) An image-receiving element; and (3) A processing element containing a means to release an alkaline processing composition in the film unit, such as a rupturable container, and further containing a silver halide developer.

It is preferred that the image-receiving sheet is composed of a support, a neutralizing layer, and, if desired, a neutralizing rate controlling layer (timing layer) which are applied to the support in the order listed.

In the following, the examples of the present invention are described. However, the present invention is not limited thereto.

EXAMPLE 1

Aqueous solutions of silver nitrate and potassium bromide were blended in the presence of 170 mg per mol of silver potassium hexachloroiridate to obtain core silver halide grains having a size of 0.15μ. Lead acetate was then added thereto in an amount of 15 mg per mol of silver, and the mixture was heated to 70° C. To the mixture, aqueous solutions of silver nitrate and potassium bromide were added to grow crystals. Thus, a core/shell type silver halide emulsion having an average edge length of 0.3μ was prepared (Emulsion I).

Then, Emulsion II was prepared by the same procedure as in Emulsion I, except that the amount of lead acetate added was 3 mg per mol of silver.

After core silver halide grains having a grain size of 0.3μ containing 120 mg, per mol of silver, of potassium hexachloroiridate were prepared by the same procedure as in Emulsion I, lead acetate was added in amounts shown in Table 1, and aqueous solutions of silver nitrate and potassium bromide were added thereto to prepare core/shell type silver halide emulsions having a grain size of 0.45μ (Emulsions III and IV).

Emulsions I and III and Emulsions II and IV were blended respectively in the same amounts with each other, and the fogging agent 1-formyl-2-[4-(3-phenylureido)phenyl]hydrazine was added in an amount of 150 mg per mol of silver to the blended emulsions. Then they were applied to polyethylene terephthalate supports so as to result in a silver amount of 300 mg/m$^2$. To the resulting layers, a gelatin protective layer was applied to prepare Samples 1 and 2.

After these samples were allowed to stand at a temperature of 50° C. and a relative humidity of 10% for 4 days, they were exposed to the light of a 1 kW tungsten lamp having a color temperature of 2854° K. for 1 second through a stepwedge, and they were then developed with Developing solution C as shown in Table 2 at 35° C. for 1 minute. They were then subjected to stopping, fixing, and washing with water according to the conventional manner. On the other hand, after Samples 1 and 2 were stored at a room temperature (25° C.) and a relative humidity of 90% for 3 days, they were exposed to light of the same condition and developed with the same developing solution together with the above described samples.

In Table 1, changes of the reversal sensitivity of each sample over the passage of time are shown. The change of sensitivity is a value obtained by substracting the sensitivity after the passage of time from the sensitivity before the passage of time. Further, the sensitivity is shown as a value −log E at which the optical density becomes (Dmin+Dmax)/2.

TABLE 1

| | Mixing | | | | | | Change of Sensitivity | |
|---|---|---|---|---|---|---|---|---|
| Sample | Emulsion | Grain Size | Pb ion (mols/mol Ag) | Emulsion | Grain Size | Pb ion (mols/mol Ag) | 50° C., 10% RH for 4 days | 25° C., 90% RH for 3 days |
| 1 | I | 0.3μ | $5 \times 10^{-5}$ | III | 0.45μ | $1 \times 10^{-5}$ | −0.29 | +0.20 |
| 2 | II | " | $1 \times 10^{-5}$ | IV | 0.45μ | $5 \times 10^{-5}$ | −0.12 | +0.08 |

It is clear from the above described results that Sample 2 produced remarkably improved stability with respect to the passage of time by using an emulsion having a larger average grain size which was doped with a larger amount of lead ions than the emulsion of smaller average grain size.

TABLE 2

| Developing solution C | |
|---|---|
| Sodium sulfite | 50 g |
| Potassium carbonate | 40 g |
| Sodium bromide | 5 g |
| 1-Phenyl-3-pyrazolidone | 2 g |
| Hydroquinone | 22 g |
| 5-Methylbenzotriazole | 22 mg |
| Water to make | 1 l |
| The pH was controlled with KOH to 11.8 | |

EXAMPLE 2

Equimolar amounts of solutions of silver nitrate and potassium bromide were blended at a temperature of 55° C. for 20 minutes by a controlled double jet process to obtain a silver bromide emulsion. When precipitation had been completed, cubic crystals having an average edge length of 0.1μ were obtained. The resulting silver bromide was subjected to chemical sensitization by adding 40 mg of sodium thiosulfate per mol of silver, 40 mg of chloroaurate (tetrahydrate) per mol of silver and lead acetate in amounts shown in Table 3, and heating to 75° C. for 60 minutes. Using the resulting silver bromide grains as cores, solutions of silver nitrate and potassium bromide were added thereto to grow crystals by a double jet process, and octahedral core/shell grains having an average edge length of 0.25μ were finally obtained. As surface sensitizers, 3.4 mg of sodium thiosulfate per mol of silver and 3.4 mg of chloroaurate (tetrahydrate) per mol of silver were added thereto, and the mixtures were heated to 60° C. for 60 minutes to prepare internal latent image type direct positive emulsions (Emulsions V and VI).

Further, solutions of silver nitrate and potassium bromide were added at constant rates and blended at 55° C. for 30 minutes in the same manner as in Emulsions V and VI to form emulsions of roundish octahedral silver bromide having a grain size of about 0.2μ. As surface sensitizers, 30 mg of sodium thiosulfate per mol of silver bromide, 20 mg of chloroaurate (tetrahydrate) per mol of silver and lead acetate in amounts shown in Table 3 were added thereto, and the mixtures were heated at 75° C. for 60 minutes. Using the resulting silver bromide grains as cores, solutions of silver nitrate and potassium bromide were added thereto by a double jet process to finally obtain octahedral core/shell grains having an average edge length of 0.35μ. As surface sensitizers, 0.5 mg of sodium thiosulfate per mol of silver and 0.5 mg of chloroaurate (tetrahydrate) per mol of silver were added thereto, and the mixtures were heated to 60° C. for 60 minutes to prepare internal latent image type direct positive emulsions (Emulsions VII and VIII).

Using Emulsions V to VIII, Samples 3 and 4 were prepared by the same manner as in Example 1. Namely, Emulsions V and VII and Emulsions VI and VIII were blended in the same amounts, respectively. The fogging agent 1-formyl-2-{4-[3-(4-methoxyphenyl)ureido]-phenyl}hydrazine was added thereto in an amount of 150 mg per mol of silver. They were applied so as to result in a silver amount of 3000 mg/m$^2$.

After these Samples 3 and 4 were stored by the same manner as in Example 1, they were exposed to light and developed. Results are shown in Table 3.

TABLE 3

| | Mixing | | | | | | Change of Sensitivity | |
|---|---|---|---|---|---|---|---|---|
| Sample | Emulsion | Grain Size | Pb ion (mols/mol Ag) | Emulsion | Grain Size | Pb ion (mols/mol Ag) | 50° C., 10% RH for 4 days | 25° C., 90% RH for 3 days |
| 4 | V | 0.25μ | 0 | VII | 0.35μ | $3 \times 10^{-5}$ | −0.10 | +0.08 |
| 5 | VI | " | $3 \times 10^{-5}$ | VIII | 0.35μ | 0 | −0.25 | +0.30 |

It is understood that stability with the passage of time was significantly improved in the case of chemically sensitizing the surface, if the grains having a larger grain size were doped with lead ions.

EXAMPLE 3

Emulsions IX and IX′ were prepared in the same manner as in Emulsion VII in Example 2, except that cadmium bromide was added in an amount of about $3 \times 10^{-6}$ mols per mol of silver or rhodium trichloride was added in an amount of about $5 \times 10^{-7}$ mols per mol of silver, instead of lead acetate added during physical ripening of the core grains. The resulting Emulsions IX and IX' were blended with Emulsion V in Example 2 in the same amounts, respectively, to prepare Samples 5 and 5'.

When changes of sensitivity with the passage of time were measured using these Samples 5 and 5' in the same manner as in Example 2, stability with the passage of time was significantly improved similarly to the case of using lead acetate.

EXAMPLE 4

Core/shell emulsions having an average edge length of 0.35μ (Emulsions X and XI) were prepared by the same procedure as in Emulsion VI in Example 2, except that the amount of lead acetate was varied to those described in Table 4.

Then, the following emulsions were prepared by the same procedure as in Emulsions X and XI. Solutions of silver nitrate and potassium bromide were added by a double jet process to obtain an emulsion of octahedral silver bromide cores having an average edge length of about 0.3μ. This emulsion was divided into three equal parts. To each part, 20 mg of sodium thiosulfate per mol of silver bromide and 10 mg of chloroaurate (tetrahydrate) per mol of silver were added, and lead acetate was added in amounts shown in Table 4 per mol of silver. The mixtures were heated to 75° C. for 60 minutes to prepare three kinds of core emulsions. To each silver halide core emulsion, aqueous solutions of silver nitrate and potassium bromide were added to finally obtain three kinds of octahedral core/shell type grains having an average edge length of 0.5μ. As a surface sensitizer, 1 mg of sodium thiosulfate per mol of silver was added thereto, and the mixtures were heated to 60° C. for 60 minutes to prepare three kinds of internal latent image type direct positive emulsions (Emulsions XII, XIII and XIV).

These Emulsions VI, X and XI were blended with Emulsions XII to XIV in a ratio of 1:2 as shown in Table 4, and the fogging agent 2-{4-[3-(3-benzenesulfonamidophenyl)-ureido]phenyl}-1-formylhydrazine was added in an amount of 120 mg per mol of silver. The mixtures were applied to polyethylene terephthalate supports so as to result in a silver amount of 3000 mg/m$^2$ to prepare Samples 6 to 8.

These samples were stored, exposed to light and developed under the same conditions as in Example 1. Results are shown in Table 4.

TABLE 4

| | Mixing | | | | | | Change of Sensitivity | |
|---|---|---|---|---|---|---|---|---|
| Sample | Emulsion | Grain Size | Pb ion (mols/mol Ag) | Emulsion | Grain Size | Pb ion (mols/mol Ag) | 50° C., 10% RH for 4 days | 25° C., 90% RH for 3 days |
| 6 | X | 0.35μ | $1 \times 10^{-5}$ | XII | 0.5μ | $5 \times 10^{-5}$ | −0.08 | +0.04 |
| 7 | VI | " | $3 \times 10^{-5}$ | XIII | " | $3 \times 10^{-5}$ | −0.18 | +0.13 |
| 8 | XI | " | $5 \times 10^{-5}$ | XIV | " | $1 \times 10^{-5}$ | −0.20 | +0.25 |

It is understood from Table 4 that storage stability was significantly improved in Sample 6 wherein grains having a larger average grain size were doped with a larger amount of lead ions.

EXAMPLE 5

To Emulsions X, VI and XI in Example 4, the fogging agent 1-formyl-2-{4-[3-(4-methoxyphenyl)ureido]-phenyl}hydrazine was added in an amount of 150 mg per mol of silver. The emulsions were applied to polyethylene terephthalate supports so as to result in a silver amount of 1000 mg/m$^2$. To the resulting layers, Emulsions XII, XIII and XIV in Example 4, to which the above described fogging agent was added in an amount of 150 mg per mol of silver, were applied, respectively, so as to result in a silver amount of 2000 mg/m$^2$. Then, a gelatin protective layer was applied by the same manner as in Example 1 to prepare Samples 9 to 11.

After these samples were stored in the same manner as in Example 1, they were exposed to light and developed. Results obtained are shown in Table 5.

TABLE 5

| | Mixing | | | | | | Change of Sensitivity | |
|---|---|---|---|---|---|---|---|---|
| Sample | Emulsion | Grain Size | Pb ion (mols/mol Ag) | Emulsion | Grain Size | Pb ion (mols/mol Ag) | 50° C., 10% RH for 4 days | 25° C., 90% RH for 3 days |
| 9 | X | 0.35μ | $1 \times 10^{-5}$ | IV<br>XII | 0.5μ | $5 \times 10^{-5}$ | −0.08 | +0.04 |
| 10 | VI | " | $3 \times 10^{-5}$ | XIII | " | $3 \times 10^{-5}$ | −0.13 | +0.10 |
| 11 | XI | " | $5 \times 10^{-5}$ | XIV | " | $1 \times 10^{-5}$ | −0.18 | +0.21 |

It is understood from Table 5 that stability of the light-sensitive material with the passage of time was significantly improved by doping grains having a larger average grain size with a larger amount of lead ions, in case that two kinds of internal latent image type emulsions were applied in layers (Sample 9).

While the invention has been described in detail and with reference to specific embodiments thereof, it will be apparent to one skilled in the art that various changes and modifications can be made therein without departing from the spirit and scope thereof.

What is claimed is:

1. A direct positive photographic light-sensitive material comprising a support and at least one internal latent image silver halide emulsion layer containing core/shell silver halide grains which are composed of a silver halide core containing lead ions, cadmium ions or Group VIII metal ions, and a silver halide shell covering at least sensitivity sites of said core, and a binder, wherein said core/shell silver halide grains consist of two or more kinds of grains in a same or in different emulsion layers, each said kind of grain having a different average grain size, and the core of each said kind of core/shell silver halide grains having larger average grain size is doped with lead ions, cadmium ions, or Group VIII metal ions in an amount of more than 10% higher than the amount of the smaller of said kind of grains is doped, the amount of metal ions doped is in a range of from $10^{-8}$ to $10^{-4}$ mols per mol of silver halide, and the difference in the average grain size between the larger grains and the smaller grains is at least 0.1μ, or 20% or more of said difference.

2. A direct positive photographic light-sensitive material as in claim 1, wherein one or more monodispersed emulsions are used.

3. A direct positive photographic light-sensitive material as in claim 1, wherein the average grain size of the core/shell silver halide grains is from about 0.1 to 4 microns.

4. A direct positive photographic light-sensitive material as in claim 1, wherein the difference in the average grain size between the larger grains and the smaller grains is 20% or more in terms of the difference.

5. A direct positive photographic light-sensitive material as in claim 1, wherein the core/shell silver halide grains are doped with lead ions or cadmium ions in an amount range of from $10^{-8}$ to $10^{-4}$ mols per mol of silver halide.

6. A direct positive photographic light-sensitive material as in claim 1, wherein the core/shell silver halide grains are doped with Group VIII metal ions in an amount range of from $10^{-8}$ to $10^{-5}$ mols per mol of silver halide.

7. A direct positive photographic light-sensitive material as in claim 1, wherein the grains having a larger average grain size are doped with lead ions, cadmium ions, or Group VIII metal ions in an excess amount of more than 50% higher than the amount in the grains having a smaller average grain size.

8. A direct positive photographic light-sensitive material as in claim 1, wherein the grains having a larger average grain size are doped with lead ions, cadmium ions, or Group VIII metal ions in an excess amount of more than 100% higher than the amount in the grains having a smaller average grain size.

9. A direct positive photographic light-sensitive material as in claim 1, wherein the core/shell silver halide grains having a larger average grain size are used in an amount of from 0.1 to 10 times by weight, the weight of the grains having a smaller average grain size.

10. A direct positive photographic light-sensitive material as in claim 1, wherein the core/shell silver halide grains having a larger average grain size are used in an amount of from $\frac{1}{3}$ to 3 times by weight, the weight of the grains having a smaller average grain size.

11. A direct positive photographic light-sensitive material as in claim 1, wherein the difference in the average grain size between the larger grains and the smaller grains is at least 0.1μ.

* * * * *